United States Patent [19]

Michael

[11] 4,370,227

[45] Jan. 25, 1983

[54] VACUUM DRAIN FACILITY

[75] Inventor: Harald R. Michael, Hamburg, Fed. Rep. of Germany

[73] Assignee: Electrolux GmbH, Hamburg, Fed. Rep. of Germany

[21] Appl. No.: 179,473

[22] Filed: Aug. 19, 1980

Related U.S. Application Data

[63] Continuation of Ser. No. 54,921, Jul. 5, 1979, abandoned, which is a continuation of Ser. No. 832,812, Sep. 13, 1977, abandoned.

[30] Foreign Application Priority Data

Sep. 13, 1976 [DE] Fed. Rep. of Germany ..... 2641110

[51] Int. Cl.[3] ..... C02F 1/00

[52] U.S. Cl. ..... 210/170; 137/205; 137/236 R; 210/406; 210/416.1

[58] Field of Search ..... 4/317; 137/205, 236; 210/170, 406, 416.1

[56] References Cited

U.S. PATENT DOCUMENTS

| | | | |
|---|---|---|---|
| 485,953 | 11/1892 | Leedy | 137/236 X |
| 3,211,167 | 10/1965 | Clift et al. | 137/236 |
| 3,628,194 | 12/1971 | Liljendahl | 137/236 X |
| 3,686,693 | 8/1972 | Liljendahl | 137/205 X |
| 3,730,884 | 5/1973 | Burns et al. | 137/236 X |
| 3,746,032 | 7/1973 | Wallgren | 137/205 |

FOREIGN PATENT DOCUMENTS

| | | | |
|---|---|---|---|
| 555708 | 3/1957 | Belgium | 137/236 |

*Primary Examiner*—Robert H. Spitzer
*Attorney, Agent, or Firm*—William R. Hinds

[57] ABSTRACT

A vacuum drain sewage facility is disclosed, having a plurality of house connections in which relatively small amounts of water collected at the house connections are admitted into the vacuum conduit of the system, followed immediately by a volume of air from two to fifteen times the liquid volume. The vacuum conduit is connected to a collecting tank that is under vacuum. The conduit has ascending and descending sections, the vacuum conduit in the vicinity of the house connections being laid out in the direction of flow with relatively short ascending sections and relatively long descending sections, the descending sections being at least twice as long as the ascending sections. The length of the ascending conduit sections is from one to twenty meters, with the rise of the ascending conduit sections being 0.85 to 5 meters. The ascending conduit sections preferably are of smaller cross section than the descending sections.

7 Claims, 1 Drawing Figure

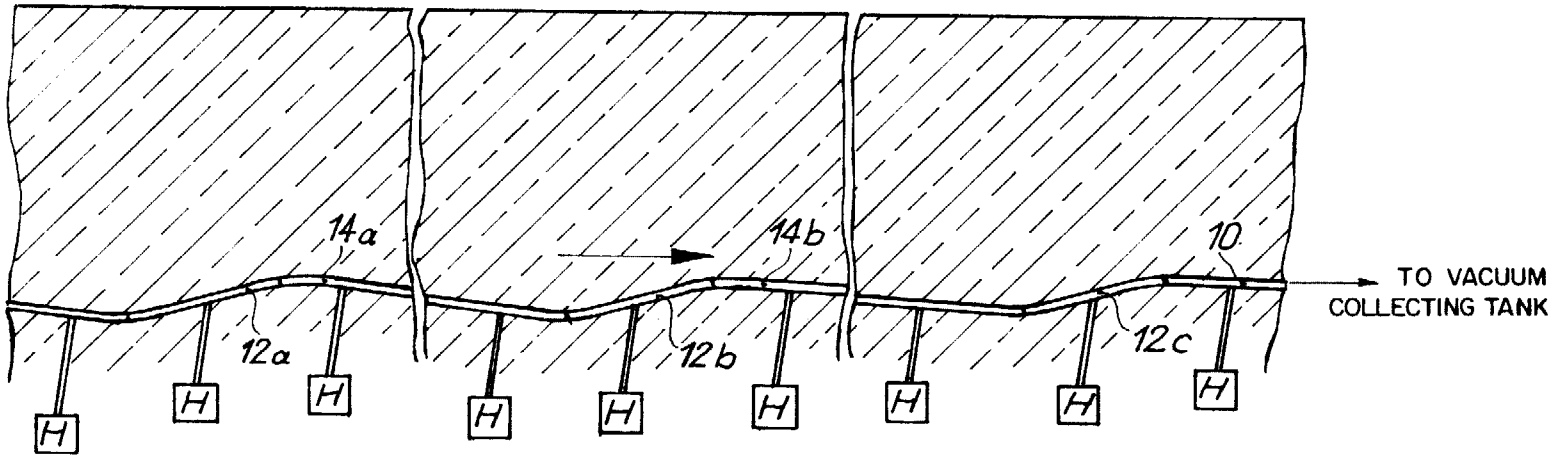
TO VACUUM
COLLECTING TANK
10
12c
14b
12b
14a
12a
H

VACUUM DRAIN FACILITY

This is a continuation, of application Ser. No. 54,921 filed July 5, 1979 which was a continuation of Ser. No. 832,812, filed on Sept. 13, 1977, both abandoned.

FIELD OF THE INVENTION

This invention relates to a vacuum drain facility or system, particularly a sewage system, with a plurality of house connections, wherein relatively small amounts of water collected at the house connections, together with air volumes of two to fifteen times the liquid volumes, are admitted to the vacuum conduit system, the air volumes immediately following the liquid volumes. The vacuum conduit system is connected with a collection tank that is under vacuum, and the conduit system presents ascending and descending sections.

BACKGROUND AND SUMMARY OF THE INVENTION

A vacuum drain facility of this type is described in German OS No. 2,455,551, for example. Reference is also made to my copending applications Ser. No. 736,209, filed Oct. 27, 1976, Ser. No. 784,844 filed Apr. 5, 1977, and a further application filed Aug. 22, 1977, entitled "Vacuum Drainage System" (Ser. No. presently unknown), for further exemplary disclosures of or in connection with such systems. In a facility of the kind to which the instant invention relates, the layout of the conduit with ascending and descending sections results from topographical conditions, as in other known vacuum drain facilities also (see for example German Pat. No. 1,238,858 and German OS No. 2,117,353). In contrast to free fall or gravity conduits, a vacuum conduit may be adapted to the terrain. Also, the layout may be effected independently of the terrain in order to have water standing in the conduit collect in catches or pockets and form plug there, which plugs fill the conduit sections and are entrained by the air admitted when the house connections are emptied. Plug formation could be readily attained by an arrangement whereby the vacuum conduit, at specific distances (generally next to an inspection pipe so arranged that the pipe would open into the catcher), would be firmly lined with sand and thereby primed here and there. In the vicinity of the house connections, that is, between the house connections, the provision of catchers or pockets in the vacuum conduit for plug formation has appeared to be unnecessary, because the air flowing in at each house connection when emptied first would drive the previously admitted water ahead of it for a fairly long distance before overtaking it, so that it remained in the conduit on its way to the collecting tank. In any case, in considering the plug formation that was a governing consideration in this conduit layout, the length-to-ascent ratio of ascending and descending conduit sections was not essential.

Previous conduit layouts, with or without a catcher in the vicinity of the house connections, led from time to time to malfunctioning of the system, because the water introduced through a house connection flowed at least in part backwardly if, for example, the vacuum in the line between the house connection and the collecting tank momentarily was reduced. This might happen when, for example, air penetrated the area from somewhere else, or a large volume of water stood in the line during inoperative periods, while the backward or upstream part of the conduit system formed a powerful vacuum reservoir.

The instant invention is concerned with the problem of correcting as quickly as possible such system-conditioned defects of flow direction of waste water sucked into the line. For the solution of this problem, it is proposed in accordance with the invention that the vacuum conduit in the region of the house connections be laid out in the flow direction alternatingly with short ascending sections and descending sections that are at least twice as long. The length of the ascending sections can amount to one to twenty meters, with the length increasing with the pipe cross section. The rise of the ascending conduit section may also vary over a relatively broad range, of 0.05 to about 5 meters.

The relatively long descending sections are essential to the purpose of the instant invention, because they bring about the effect that water flowing backwardly as a result of momentary pressure conditions will stagnate. It is especially important that in the long conduit sections, water flowing backwardly upstream will no longer fill the whole conduit cross section after a certain period, that is, it will no longer form a plug, so that any air that may flow backwardly, driving the water, will be expanded in the free space in the conduit at the upper portion of the long flat conduit section and thus lose its driving force. Vice versa, with the same rise in the shorter steeper conduit sections, a water plug in the vacuum line will be more easily overcome because in the short sections pipe friction does not play such an important roll, and the water with the same kinetic energy will more readily reach a crest in the conduit.

The effect that is sought and achieved by the instant invention can be further enhanced if the ascending sections in the flow direction are of smaller cross section than that of the descending portions. In the latter case, the air penetrates a water plug more readily than it would with a narrow conduit.

In the system of the instant invention, in the region between the house connections, it is of no importance as far as the overall function of the facility is concerned if the house connections open into an ascending or a descending part of the conduit. Therefore, in laying out the vaccum conduit with ascents and descents, there is practically no need to take into account the location of the house connections.

BRIEF DESCRIPTION OF THE DRAWING

The single drawing FIGURE is a schematic illustration of a preferred embodiment of the invention.

DESCRIPTION OF THE PREFERRED EMBODIMENT

Referring to the single drawing figure, an unbranched vacuum conduit 10 has a plurality of house connections H opening into the conduit. Vacuum conduit 10 is laid out with relatively short ascending sections 12*a*, 12*b*, 12*c*, and relatively long descending sections 14*a*, 14*b*. The house connections open both into the ascending and descending sections. The direction of flow in the vacuum conduit is indicated by the arrow.

Since vacuum conduits of the kind involved here are made with plastic piping, e.g. PVC high-pressure pipe, which has a relatively high degree of elasticity, there is normally no problem in laying out the conduit in the illustrated up-and-down curved configuration. In any case, the length of conduit sections 12 and 14 depends upon the pipe cross section. The ascending portions, depending upon pipe diameter, are one to twenty meters in length, and sections 14 which descend in the direction of flow are at least twice as long as ascending sections 12, but they may be made much longer than the 1:2 proportion indicated.

The rise of the ascending sections may amount to 0.05 to 5 meters, but, as a rule, the difference in level will be less than one meter.

The various connections, valves, collecting tanks, house connection details, etc. required in a complete system form no part of the instant invention, and are not unique to the instant invention, being known in the art. Accordingly, such details are neither illustrated nor described herein.

Having thus described my invention as required by the statute, including the preferred embodiment thereof, I claim:

1. In a vacuum drain sewage facility comprising a vacuum conduit connected to a collecting tank that is maintained under vacuum so as to move liquid therethrough without requiring a gravity flow layout, a plurality of house connection means to said vacuum conduit for admitting to the conduit relatively small amounts of collected liquid followed immediately by air in the amount of 2 to 15 times the liquid volumes, said conduit presenting ascending and descending sections, the improvement comprising means for counteracting intermittent wrong-way flow in said conduit, said counteracting means comprising an arrangement wherein the vacuum conduit in the vicinity of the house connections is laid out in the direction of flow with alternating relatively short ascending sections and relatively long descending sections at least twice as long as the ascending sections.

2. A vacuum drain facility as claimed in claim 1 wherein the length of the ascending conduit sections is from 1 to 20 meters.

3. A vacuum drain facility as claimed in claim 2 wherein the rise of the ascending conduit sections is between 0.05 and 5 meters.

4. A vacuum drain facility as claimed in claim 1 wherein the ascending conduit sections are of smaller cross section than the descending sections.

5. A vacuum drain facility as claimed in claim 1 wherein said house connections open into both ascending and descending sections of said vacuum conduit.

6. A vacuum drain facility as claimed in claim 1 wherein the overall elevational change of said vacuum conduit in the vicinity of at least some of said house connections is insufficient to effect gravitional flow therethrough from the house connections to the collecting tank.

7. A vacuum drain facility as claimed in claim 1 wherein the layout of said conduit is such that a malfunction such as a temporary reduction of the vacuum in the line between a house connection and the collecting tank, could result in liquid introduced through a house connection tending to flow at least in part backwardly.

* * * * *